United States Patent [19]

Mumford

[11] Patent Number: 4,717,034

[45] Date of Patent: Jan. 5, 1988

[54] ONE-PIECE THERMOPLASTIC CLOSURE HAVING PRESS-ON SCREW OFF STRUCTURE INCLUDING SPACED VERTICAL RIBS IN THE SKIRT OF THE CLOSURE

[75] Inventor: George V. Mumford, Ventura, Calif.

[73] Assignee: Owens-Illinois Closure Inc., Toledo, Ohio

[21] Appl. No.: 395,397

[22] Filed: Jul. 6, 1982

[51] Int. Cl.[4] ..... B65D 41/16

[52] U.S. Cl. ..... 215/318; 215/341; 215/345; 215/350

[58] Field of Search ..... 215/318, 329, 330, 341, 215/343, 345, 350, 334

[56] References Cited

U.S. PATENT DOCUMENTS

| | | | |
|---|---|---|---|
| 2,039,757 | 5/1936 | Von Till | 215/329 |
| 3,270,904 | 9/1966 | Foster et al. . | |
| 3,371,813 | 3/1968 | Owen et al. | 215/345 |
| 3,448,881 | 6/1969 | Zipper . | |
| 3,606,062 | 9/1971 | Frisch et al. . | |
| 3,917,100 | 11/1975 | Dukess | 215/329 |
| 4,000,825 | 1/1977 | Westfall . | |
| 4,256,234 | 3/1981 | Mori et al. | 215/343 |
| 4,308,965 | 1/1982 | Dutt | 215/345 |
| 4,340,149 | 7/1982 | Mori et al. | 215/343 |
| 4,379,512 | 4/1983 | Ohmi et al. | 215/343 |

FOREIGN PATENT DOCUMENTS

| | | | |
|---|---|---|---|
| 635262 | 4/1950 | United Kingdom | 215/329 |

*Primary Examiner*—Stephen Marcus
*Assistant Examiner*—David T. Fidei
*Attorney, Agent, or Firm*—H. G. Bruss

[57] ABSTRACT

A closure for a container having generally helical threads on the neck finish is formed from a one-piece cap shell of thermoplastic material including a top wall and a peripheral skirt, the skirt having a plurality of spaced, hard, flexible generally vertical thermoplastic ribs integral with the shell for contacting the threads of the container. Each rib is so constructed and arranged that it has sufficient resistance to cold flow that it only slightly flexes and bends around the thread to form a shallow indentation on the rib when the rib is forced into contact with the thread, the indentation being sufficient to provide purchase on the threads for removing the closure.

2 Claims, 11 Drawing Figures

ONE-PIECE THERMOPLASTIC CLOSURE HAVING PRESS-ON SCREW OFF STRUCTURE INCLUDING SPACED VERTICAL RIBS IN THE SKIRT OF THE CLOSURE

The present invention relates to thermoplastic closures and particularly one-piece thermoplastic closures including a top and a skirt with means on the skirt to engage removably the threads of a container.

BACKGROUND OF THE INVENTION

It is desirable to provide a plastic closure with a press-on screw-off structure that is adapted for production, for easy use, and adapted for vacuum capping operation for liquids such as apple juice that are warm when capped, the temperatures being moderately high such as in the range of 180°–205° F. It is also desirable to have a simple closure that would permit the release of internal pressure in the event of product spoilage and one that can be removed very easily with relatively small amount of torque.

It has heretofore been proposed, for example, in U.S. Pat. No. 3,371,813 (Owen et al) to provide a soft readily deformable gasket material inside the skirt of a metal closure, the gasket material being said to deform readily and flow around the threads of a container to form cooperating thread grooves in the gasket material. The gasket material is soft, deformable and a material that sets to retain the grooves. This formation of well defined cooperating set grooves for threads in the gasket material is said to provide purchase or leverage on the threads to permit opening of the container by twisting the cap. The U.S. Pat. No. 3,371,813 suggests that the resilient deformable gasket material forming the ribs be at least about 20% and generally about 30–70% of the total circumferential surface area of the gasket skirt to provide increased package security and greater cam off force against the continuous threads.

U.S. Pat. No. 4,000,825 (Westfall) for a press-on twistoff metal closure for oxygen sensitive products describes a top liner having spaced-apart vertical ribs inside the skirt of the shell of the closure. The liner is formed preferably from a foamed plastisol material that deforms and cold flows around the threads of the neck of a container to form a series of thread-cooperating cavities in the foamed liner that sets to aid in removal of the closure using a twist-off motion. The patent shows a top seal in addition to sealing with deformation of the ribs.

In U.S. Pat. No. 3,270,904 (Foster et al) there is a press-on turn-off metal cap, the cap having a gasket material at the top and around the bottom of the skirt, the gasket material in the skirt engaging the threads of the container. The gasket material is described as plastomeric and takes a conformation to form a hermetic seal cooperating with the thread means of the container finish. The plastomeric material hardens to form rigid thread grooves therein for the camming operation with the raised threads of the neck of the container.

U.S. Pat. No. 3,606,062 (Frisch et al) discloses a crimp-on twist-off metal crown cap with top and corner seals. There are deformable metal flutes in the metal shell to engage the threads of the container.

U.S. Pat. No. 3,448,881 (Zipper) discloses a metal closure with a gasket for engaging the threads of a container, the metal closure having means to prevent an increase in cap removal torque including a ridge on the underside of the cap to prevent settling of the cap due to gradual deformation of the gasket material. Grooves are formed in the gasket by the threads of the container when the metal cap is applied to the threads.

In general, in the above patents that describe metal caps with soft deformable gaskets that set, there is substantial contact between the deformable gasket ribs and the container threads such as contact of the entire rib or as, for instance, in the Owens et al patent, the ribs are shaped for substantial contact with the threads and comprise 20% up to 70% of the gasket area. The forcing of the gasket ribs against the threads causes the soft deformable gasket ribs to form grooves, the material thereafter setting to retain the grooves.

It is an object of the present invention to provide a closure for a container in which there is a one-piece structure so constructed and arranged that ribs on the skirt slightly flex and bend around the threads of the container to form shallow indentations for easy twist-off of the cap requiring less torque than closures of the prior art in which the prior art ribs are made of relatively soft deformable gasket materials.

It is an object of the present invention to provide a plastic closure for a container having generally helical threads on the neck finish, the closure comprising an easily manufactured one-piece cap shell of thermoplastic material including the top wall and a peripheral skirt, the skirt having means thereon for engaging threads of the neck of a container, the means including a plurality of spaced-apart, flexible generally vertical thermoplastic ribs integral with the skirt, each rib being so constructed and arranged that it has sufficient resistance to cold flow that the rib only slightly flexes and bends around the thread to form a slight indentation on the rib when the rib is forced into contact with the thread, the slight indentation being sufficient to provide purchase on the threads for very easy removal of the closure.

It is an object of the present invention to provide a cap structure that is easy to manufacture and useful in a vacuum capping operation, the cap being of a vacuum type push-on twist-off cap which provides greater tolerance to wet conditions which generally inhibit tightening screw caps, permits release of internal pressure in the event of spoilage, and provides just enough purchase on the threads by means of hard, flexible thermoplastic ribs to provide enough torque to remove the cap by use of far less torque than is required by caps in the prior art.

These and other objects will be apparent from the specification that follows, the appended claims and the drawings in which:

THE INVENTION

Figure 1:
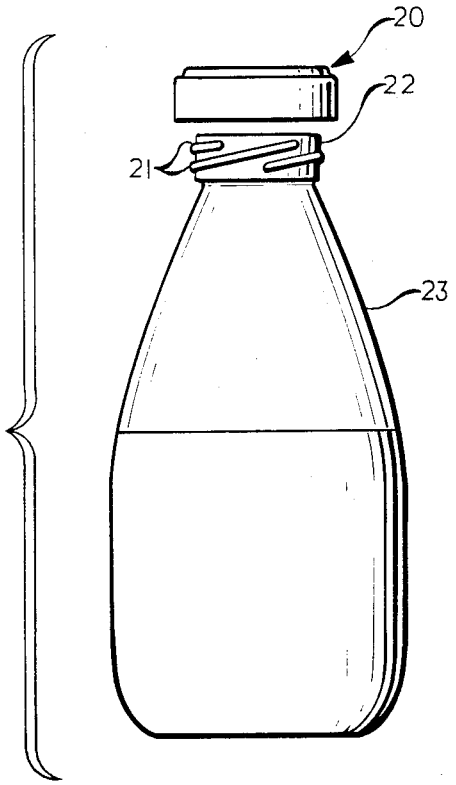
FIG. 1 is an exploded view of a container having helical threads in the neck area, and a one-piece closure embodying the present invention.

The present invention provides an economical one-piece closure for a container, the closure being easy to manufacture and easy to place on the container in a vacuum capping production operation. The closure for the container which has generally continuous or discontinuous helical threads in the neck finish, is constructed of a one-piece cap shell of thermoplastic material that is preferably high density polyethylene, the cap shell having a top wall and a peripheral skirt, the skirt having means thereon comprising a plurality of spaced-apart generally vertical ribs integral with the skirt for engaging the threads of the neck of the container, the ribs being hard, flexible and having sufficient resistance to cold flow so that each rib only slightly bends around the threads to form slight or shallow indentations on the rib when the rib is forced into contact with the thread. The shallow indentation provides just enough purchase on the threads to remove the same, the amount of torque required being substantially less than other cap structures with ribs of deformable gasket material that form relatively deep, well defined grooves to cooperate with the thread structure. The preferred thermoplastic material is one that provides just enough resistance to cold flow when forced against the thread to give a slight indentation only on the ribs. Suitable thermoplastic materials are those having a combination of properties including toughness, hardness, flexibility, resiliency, tensile modulus, creep and ease of fabrication at least about equivalent to that of high density polyethylene which, based on the technology of today, is the preferred material for the one-piece cap shell. The thermoplastic cap is preferably made of high density polyethylene having outstanding cap shell properties including a specific gravity of about 0.942 to 0.965, a melt flow index of about 0.2 to 8, a melt viscosity of about 7,000 to 120,000 poises at 190° C., a crystallinity generally of about 50–90%, a tensile modulus of about 60,000–180,000 psi, a flexural modulus at 73° C. of about 100,000–180,000 psi and a modulus at 100% elongation of about 5,000–15,000 psi. The preferred high density polyethylene material has a hardness of Shore A, durometer of about 60–80, an impact resistance of about 0.6 to 20 (Izod impact, foot pounds/inch of notch-¼ inch thick specimen), tensile strength at break of about 3,000–6,000 psi, an elongation at break of about 120–130%, a tensile yield strength of about 2,000–4,000 psi and a compressive strength (rupture or yield) of about 2,700–3,600 psi.

Although high density polyethylene is highly preferred because of its combination of outstanding properties including toughness, resiliency, creep, cold flow and tensile modulus, other polyolefins can be used such as low density polyethylene, polypropylene and polybutylene. In some cases where lower temperatures in the range of 100°–150° F. are involved, low density polyethylene is quite suitable. In case of higher temperatures, say, up to 205°–240° F., polypropylene and polybutylene are suitable. The creep rupture strength of high density polyethylene is generally about 1,000–2,000 psi at temperatures of around 23° C., this creep strength being sufficient for the closure of the present invention. Polypropylene has a creep rupture strength of 3,000 psi or more at 23° C. and the creep rupture strength at 23° C. for nylon andpolycarbonate being 5,000 psi or more. Although these creep rupture strength properties generally are measured at 1,000 hours, the short term creep property is probably more important for thermoplastic ribs of the present invention than the long term creep property.

A particularly useful high density polyethylene is one, for instance, having a density of 0.95, a crystallinity of about 65–75%, a melt flow index of 0.6, and a number average molecular weight of about 10,000–15,000. In general, number average molecular weights can range from about 6,000–100,000 for useful high density polyethylene.

As shown in FIG. 1, the thermoplastic one-piece closure 20 embodying the present invention is adapted to be applied to engaging means such as the threads 21 on the neck finish area 22 of a container 23. The one-piece closure 20 of the present invention comprises a top wall 33, a peripheral skirt 34 having a plurality of spaced-apart generally vertical ribs 40 adapted to engage the threads 21 on the neck of the container 23. The ribs are generally spaced apart and the total width of the ribs is generally less than about 10%, say about 4–8%, of the total length of the circumference of the skirt. One of the preferred shapes of the rib is the long relatively narrow rib 40. The rib 40 has a width that is about the same throughout its length, the ribs being generally narrow and the height of the ribs (projection from the skirt) is generally about the same from top to bottom.

Figure 2:
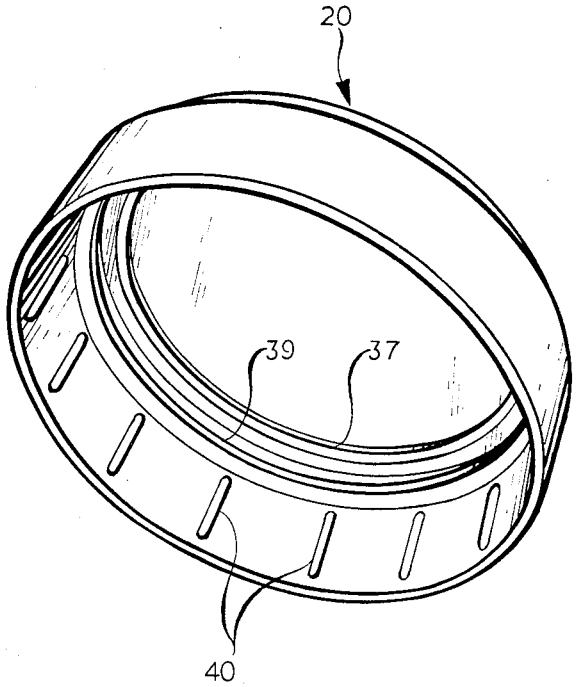
FIG. 2 is a perspective view of the inside bottom of the closure of the present invention showing the spaced-apart, rigid, flexible thermoplastic ribs.
Figure 3:
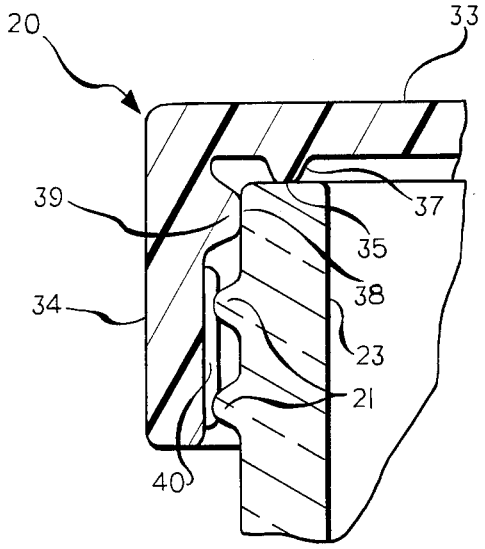
FIG. 3 is a fragmentary sectional view of the closure taken on in a large scale.

The one-piece hard plastic shell construction shown in FIGS. 2 and 3 provide a top seal at 35 with the downward projection 37 from the top 33 of the shell 20 and a top side seal 38 with the side projection 39 of the skirt 34.

Figure 4:
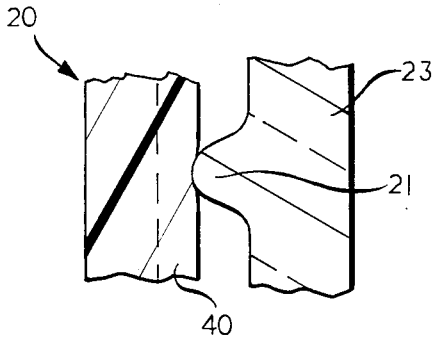
FIG. 4 is a fragmentary view of the engagement of the ribs of the shell and the threads of the glass container on a yet enlarged scale.
Figure 5:
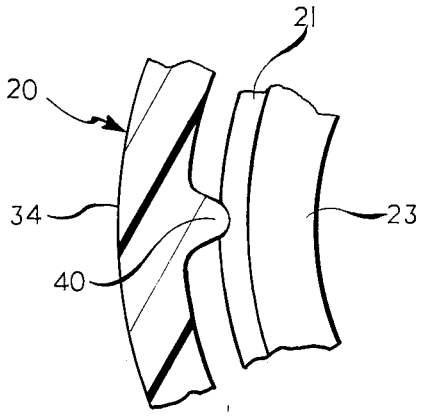
FIG. 5 is a fragmentary plan view of the closure.
Figure 6:
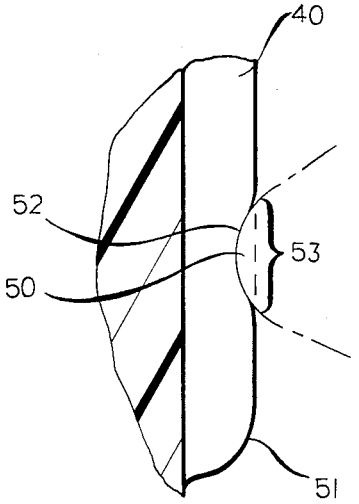
FIG. 6 is a fragmentary enlarged view of the thermoplastic rib in the closure skirt illustrating the small indentation formed when the rib is forced against a thread.

In accordance with the present invention as, for instance, seen in FIGS. 3, 4 and 5, each of the ribs 40 when forced against the threads 21 slightly bends and cold flows around the thread to form a shallow indentation 50 as best seen in the enlarged views of FIGS. 4 and 6. This slight indentation gives sufficient purchase for removal of the cap, the amount of torque being required being much less than the torque required for removal of threads from a soft resilient deformed rib. Hence the present invention provides an easy-to-manufacture, easy-to-apply vacuum cap which can be removed with little torque.

Figure 7:
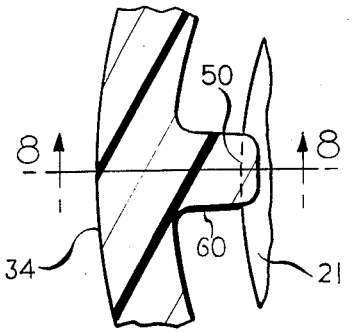
FIG. 7 is a fragmentary enlarged view of a rectangular shaped rib in the closure skirt engaging the thread of the container.
Figure 8:
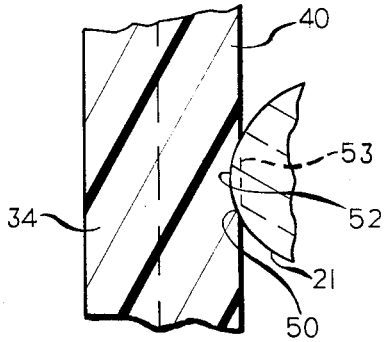
FIG. 8 is a fragmentary sectional view taken along the lines 8-8 in FIG. 7.

As seen in FIGS. 6–8, the slight indentation is of a shallow nature formed in the crest 51 of the rib, the deepest portion of the indentation at 52 generally being only about 1 to 10% of the height of the rib (the distance the rib projects from the shell skirt). The indentation length indicated at 53 generally has a dimension of about 2 to 10 times that of the indentation depth depending on the size of the thread of the container.

As seen in FIG. 7, the configuration of the rib 60 is rectangular in shape, the rib 60 projecting from the closure skirt 34 in a manner similar to that of rib 40 in FIGS. 2–6. The small indentation 50 is found in the rib 60 because of the forced engagement with the thread 21. As best seen in FIG. 8, the indentation 50 has its depth indicated at 52 and a length indicated by 53. The length 53 of the indentation is generally only about 10 to 20% of the length of the rib.

Figure 9:
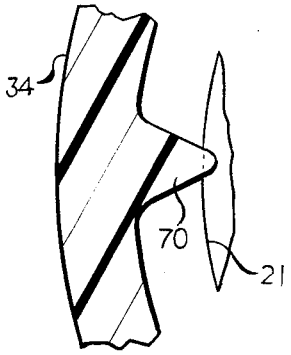
FIG. 9 is a fragmentary enlarged view of a triangular rib in the skirt engaging the thread.
Figure 10:
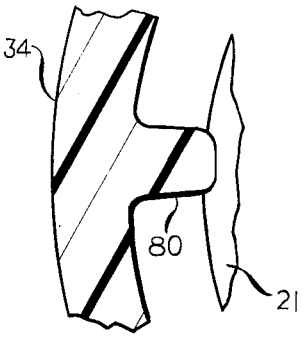
FIG. 10 is a fragmentary enlarged view of a round nose rib in the skirt engaging the thread.

FIG. 9 shows another embodiment in which a rib 70 projects from the shell skirt 34, the rib 70 being triangular in nature. FIG. 9 shows a round nose rib 80 projecting from the skirt 34. Each of the ribs 70 and 80 when forced against the thread 21 form a small indentation 50.

When the closure 20 is pushed on the container 23, the cap skirt is flexed and forced outwardly, especially during warm capping operations. The plastic memory of the all-plastic shell tends to return the skirt to its original dimension and provides some force against the container threads to slightly indent the ribs of the skirt. When the closure is removed, the slight indentation would tend to smooth out over a long time period, but the indentations remain in some form over a short term period of, say, several hours.

Figure 11:
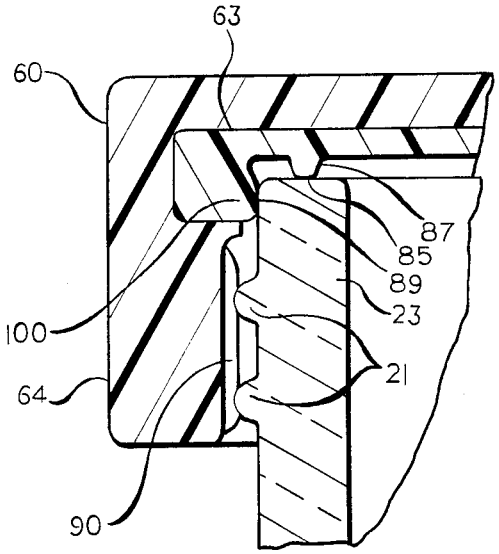
FIG. 11 is a fragmentary sectional view of another embodiment of the closure of the present invention in which a top liner is used to effect a top seal and a top side seal.

As seen in FIG. 11, in another embodiment, a hard plastic shell 60 comprising a top wall 63 and a peripheral skirt 64 is provided. A plurality of spaced-apart vertical ribs 90 are provided for engaging the threads 21 in the glass container 23. The toughness, resiliency, and resistance to creep of the ribs are the same as those of the ribs 40 of the closure of FIG. 2. The area occupied by the ribs 90, just as the ribs 40, amounts to only about 1 to 8% of the total circumferential area of the skirt. The top of the closure has a soft, resilient gasket material 82 which serves as the top liner for the cap and provides a top seal at 85 with the projection 87 and a top side seal at 89 with the downwardly projecting projection 100 which fits between the top edge of the glass container 23 and a hard shell closure 60 near the juncture of the skirt 64 and the top wall 63.

In accordance with the present invention, good results have been obtained by a vacuum capping operation of warm apple juice at about 200° F. With the closure of the present invention, the ribs provide just enough purchase with the small indentations to provide for removal of the cap, such removal being much easier than when a soft deformable rib is used. Advantageously, the plastic closure of the present invention provides an outstanding combination of sealing the top seal, the side seal and the seal at the ribs. The one-piece plastic closure construction is easy to manufacture and economical, it being less costly in the same size as a combination of a metal cap with a soft deformable gasket. Also, the plastic closure is easy to decorate and generally is more pleasing in appearance than the metal cap.

The gasket liner 80 can be made of foamed polyethylene, foamed polypropylene, foamed copolymers of ethylene and vinyl acetate, and foamed polyvinyl chloride, which foamed materials are of a closed cell construction, durable and yet ideally deformable for a top seal and a top side seal.

What is claimed is:

1. A closure for a container having generally helical threads on the neck finish, the closure comprising a one-piece molded cap shell of non-heat shrunk thermoplastic including a top wall and a peripheral skirt, the skirt having means thereon for engaging threads of the neck of a container, the means including a plurality of spaced, flexible generally vertical non-heat shrunk thermoplastic ribs integral with the skirt, each rib being so constructed and arranged that it has sufficient resistance to coald flow that the rib only slightly bends around the thread to form a slight indentation on the rib when the rib is forced into contact with the thread, the slight indentation being sufficient to provide purchase on the threads for removing the closure, there being a resilient deformable gasket liner inside the cap shell for a top seal, the liner located between the top cap wall and the top of the finish of the container, the cap shell being made of high density polyethylene and the gasket of foamed polyvinyl chloride.

2. A closure for a container having generally helical threads on the neck finish, the closure comprising a one-piece molded cap shell of non-heat shrunk thermoplastic material including a top wall and a peripheral skirt, the skirt having means thereon for engaging threads of the neck of a container, the means including a plurality of spaced, flexible generally vertical non-heat shrunk thermoplastic ribs integral with the skirt, each rib being so constructed and arranged that it has sufficient resistance to cold flow that the rib only slightly bends around the thread to form a slight indentation on the rib at the crest of the rib when the rib is forced into contact with the thread, the slight identation being sufficient to provide purchase on the threads for removing the closure, there being limited contact between the rib and threads amounting to less than 50% of the area at the crest of the rib, the thermoplastic of the rib having a modulus and resistance to cold flow at least about equivalent to that of polyethylene having a specific gravity of 0.942 to 0.965, a melt flow index of about 0.2 to 8 and a melt viscosity at 190° C. of about 7,000 to 120,000 poises, there being a resilient deformable gasket liner inside the cap shell for a top seal, the liner located between the top cap wall and the top of the finish of the container, the cap shell being high density polyethylene, the gasket being a foamed polyvinyl chloride, and each rib has a length about 3 to 4 times the width, the width being about $\frac{3}{4}$ to $1\frac{1}{4}$ times the height of the rib.

* * * * *